United States Patent [19]

Rojdev

[11] Patent Number: 4,868,957

[45] Date of Patent: Sep. 26, 1989

[54] GASKET SEAL

[75] Inventor: Iliji Rojdev, Cincinnati, Ohio

[73] Assignee: Batesville Casket Co. Inc., Batesville, Ind.

[21] Appl. No.: 155,490

[22] Filed: Feb. 12, 1988

[51] Int. Cl.[4] ..... A61G 17/00

[52] U.S. Cl. ..... 27/17; 27/2; 277/207 R

[58] Field of Search ..... 27/2, 3, 6, 14, 16, 27/17; 277/207 R, 209, 210, 211; 220/344, 357, 358

[56] References Cited

U.S. PATENT DOCUMENTS

| | | | |
|---|---|---|---|
| 2,271,777 | 2/1942 | Nathan | 277/209 |
| 2,284,921 | 6/1942 | Purkiss | 27/17 |
| 2,533,827 | 12/1950 | McEwan | 27/17 |
| 2,533,828 | 12/1950 | McEwan | 27/17 |
| 2,582,841 | 1/1952 | McEwan | 27/17 |
| 2,585,363 | 2/1952 | Woltering | 27/17 |
| 2,661,229 | 12/1953 | Slaughter, Jr. | 277/211 |
| 2,945,717 | 7/1960 | Trile | 27/17 |
| 2,995,800 | 8/1961 | Pitt | 27/17 |
| 3,065,517 | 11/1962 | Dower | 27/17 |
| 3,327,429 | 6/1967 | Slaughter | 49/485 |
| 3,461,517 | 8/1969 | Eisenhard | 27/17 |
| 3,892,417 | 7/1975 | Clayton | 277/207 R |
| 3,981,054 | 9/1976 | Hull et al. | 27/17 |
| 4,555,119 | 11/1985 | Semon | 27/17 X R |

*Primary Examiner*—Robert A. Hafer
*Assistant Examiner*—Sam Rimell
*Attorney, Agent, or Firm*—Wood, Herron & Evans

[57] ABSTRACT

A transverse rubber gasket at the joint between the head and foot sections of a cut top casket. The gasket has a pair of longitudinal ribs on one surface and aligned grooves on the opposed surface to provide space for rubber flow as the gasket is compressed.

2 Claims, 2 Drawing Sheets

GASKET SEAL

This invention relates to a casket, and more particularly, to a cut top casket and the seal among the two top sections and the body to which the top sections are hinged.

The outer shell of the casket to which the present invention is directed is formed primarily of sheet metal. It has a body and a hinged top which is formed as a foot top section and a head top section. The head top section may be opened independently of the foot top section.

The body has an upwardly-facing marginal body flange formed integrally with the body by the sheet metal being turned inwardly around the perimeter of the body. Each top section is similarly formed with integrally-inturned marginal flanges. A rubber body gasket is positioned on the marginal body flange and is engaged by the marginal flanges of the two top sections to form the major part of the seal between the top sections and the body.

There is a transverse joint between the head and foot top sections. That joint likewise must be sealed. To that end, the foot section is provided with a transverse shoulder at the joint and the head section is formed with a cooperating flange mating with the shoulder. A gasket is disposed between the shoulder and flange to form a seal at the joint.

A critical area of the sealing is created where the two ends of the head and foot joint come together at the body marginal flange. Those two areas are the most difficult to seal.

The sealing is important to prevent water from leaking into the casket when the casket is buried underground. Similarly, it is important for body gases to be prevented from leaking out of the casket when the body is finally disposed in a mausoleum above ground.

To effect a good seal, after the top is closed on the body, studs that cooperate with a wedge bar, accessible from the outside of the casket, are provided to tighten the head top section against the gasket on the foot top section and both top sections against the body gasket. See U.S. Pat. No. 2,323,674, for example. The wedge bar is cranked down in order to get the seal. The rubber forming the gaskets must be compressed to at least a ten percent reduction in thickness to obtain a satisfactory seal. The rubber can be compressed to a maximum of forty percent reduction in thickness and thereafter any continued attempt to compress the rubber causes a bending of the metal forming the flanges of the casket elements.

Because the casket is large and is formed of sheet metal, it is difficult to hold close tolerances. Therefore, in cranking down the top sections onto the body, a visible mismatch can be formed at the joint between the foot section and the head section. That mismatch may be as great as ⅛". It sometimes occurs because the transverse gasket between the foot and head section is squeezed down to the point that it can be compressed no more and yet the mismatch or misalignment has occurred.

Stated another way, in compressing the transverse gasket at the joint between head and foot sections, the rubber may not be uniformly compressed. One portion of the joint that contacts the rubber early may form a good seal while another portion has not even contacted the rubber gasket. In order to bring the second portion into a sealing engagement, the first portion may be cranked down until the forty percent upper limit of compression of the gasket has been reached. The second portion, at this point, may have formed a leak-tight seal, but nevertheless cannot be cranked down any further, because the first portion is blocked and hence a mismatch occurs.

An objective of the present invention has been to provide an improved seal particularly at the intersection of the transverse joint with the gasket on the body section.

Another objective of the present invention has been to provide a good seal across the transverse joint between the head and foot sections while avoiding an unsightly mismatch at the joint.

These objectives have been attained by providing an improved gasket cross section for the transverse gasket that permits greater movement of the head section with respect to the foot section without compressing the rubber to the forty percent reduction in thickness limit. Whereas the known gasket has a pair of parallel ribs on the surface engaged by the head section and a flat surface that lies on the foot section, the improved gasket of the present invention has the same parallel ribs on one surface but the opposed surface has parallel grooves underlying the parallel ribs. The parallel grooves provide space into which the rubber of the ribs can move as the ribs are being compressed during the closing and sealing of the casket. Thus, the improved gasket permits greater movement in the compressing direction before reaching the forty percent limit on the compression of the rubber.

In creating two grooves on the "foot" side of the transverse gasket, three ridges are formed. At the ends of the gasket, these ridges are feathered to a zero thickness at a flat end of the gasket that lies on a flat pad forming part of the body gasket. It is a feature of the present invention to provide an integral transverse dam across the feathered ends of the ridges thereby providing further assurance of a good seal of the ends of the transverse joint to the marginal body gasket.

The several features and objectives of the present invention will become more readily apparent from the following detailed description taken in conjunction with the accompanying drawings in which.

Figure 1:
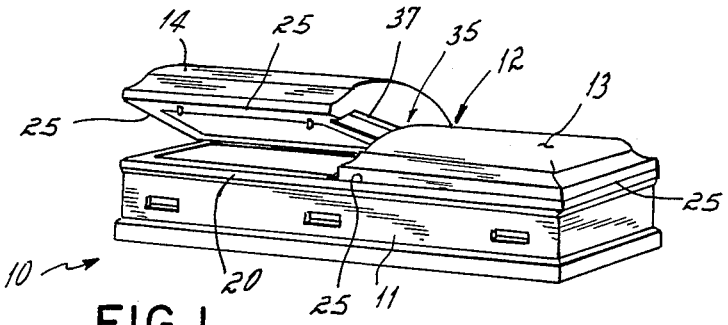
FIG. 1 is a perspective view of a casket.

A casket embodying the present invention is shown at 10. The casket has a body 11 and a top 12. The top 12 is a cut top being divided between a foot section 13 and a head section 14.

The body is formed of sheet metal. It has an upper edge 20 including an integral inturned flange 21 and a strenghtening downturned flange 22. The flange 21 is referred to as a lower marginal flange. Similarly, the sheet metal top has an integral upper marginal flange 25. A body gasket 30 is mounted on the lower marginal flange and cooperates with the upper marginal flange to form a seal around the perimeter of the body.

Between the foot section and the head section, a transverse joint 35 is formed. The foot section has a shoulder 36 and the head section has a mating flange 37, the shoulder 36 and flange 37 coming together to form the transverse joint 35. A transverse gasket 40 is positioned on the shoulder 36 and is engaged by the flange 37 to form the fluid-tight seal at the transverse joint.

Figure 3:
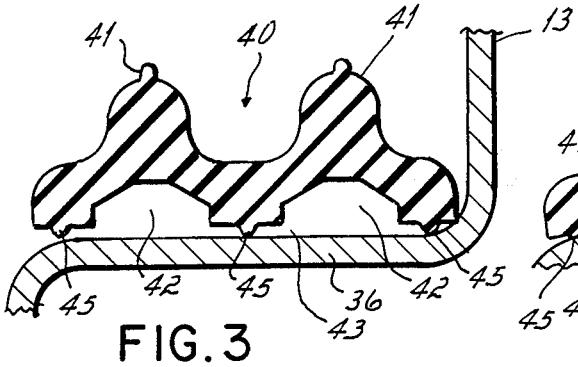
FIG. 3 is a cross-sectional view taken on line 3—3 of FIG. 2.
Figure 4:
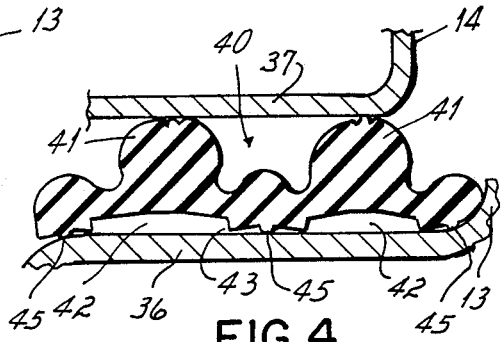
FIG. 4 is a view similar to FIG. 3, but showing the casket closed.

The gasket 40 has, over its major portion, two spaced parallel longitudinal ribs 41 (FIGS. 3 and 4). Immediately beneath the ribs 41 are grooves 42 on the undersurface 43 of the gasket 40. The grooves 42 are defined in part by three longitudinal ridges 45 on the undersurface 43 of the gasket. The gasket normally rests on the three ridges 45.

The gasket is in its unstressed condition in FIG. 3. It is in a compressed condition as shown in FIG. 4. In that figure, it can be seen that the ribs 41 are partially compressed and are driven downwardly, forcing the rubber into the area occupied by the grooves 42. Thus, the upper flange 37 is able to move the rubber, compressing it sufficiently to form a seal, but without compressing it to the upper limit of forty percent. In this way, the gasket is able to accommodate substantial variations from the normal dimensions between the foot section and the head section while avoiding a mismatch at the visible edges of the joint formed between the two sections.

Figure 2:
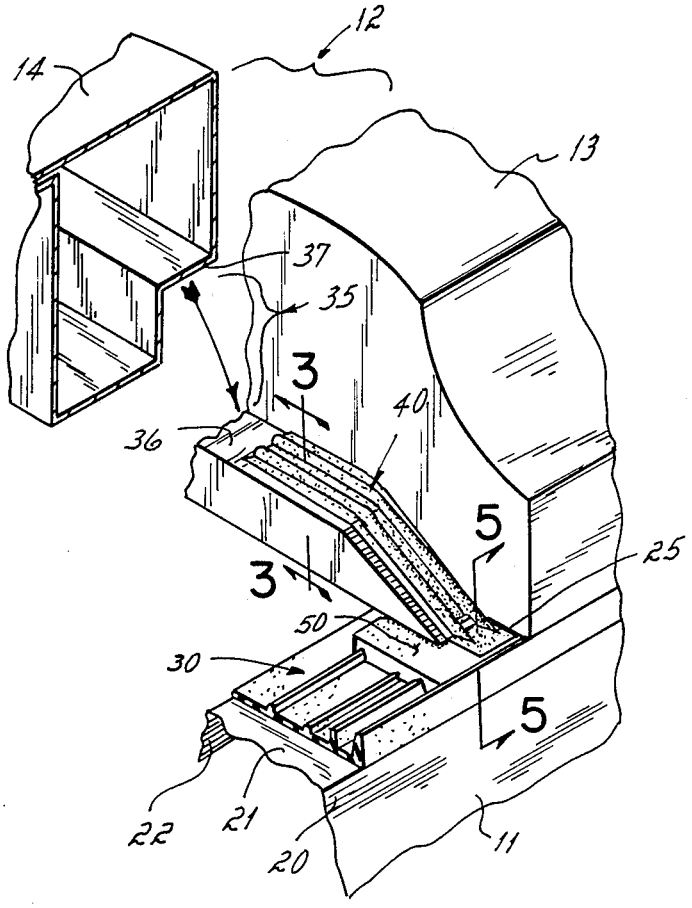
FIG. 2 is a fragmentary isometric view of the transverse seal for the casket.
Figure 5:
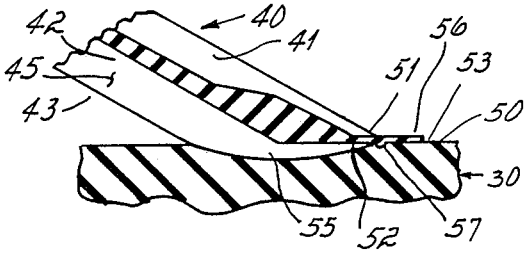
FIG. 5 is a cross-sectional view taken on line 5—5 of FIG. 2.
Figure 6:
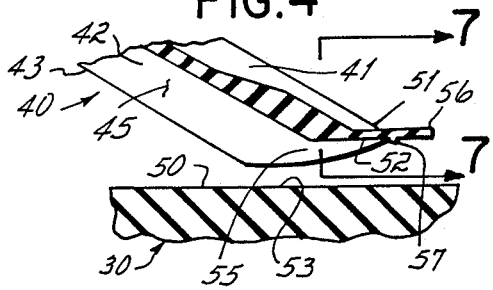
FIG. 6 is a view similar to FIG. 5 but prior to closure of the casket's foot lid.
Figure 7:
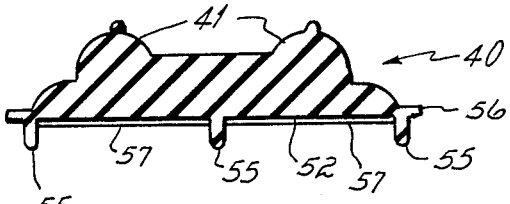
FIG. 7 is a cross-sectional view taken on line 7—7 of FIG. 6.

A critical area in the formation of the seal between the top and the body is the intersection of the transverse gasket 40 with the body gasket 30 as shown in FIGS. 2 and 5. At that intersection, the body gasket is formed as a pad 50. The transverse gasket 40 has at each end a feathered end 51 which has an undersurface 52 in engagement with the upper surface 53 of the pad 50. At the undersurface 52, the ridges 45 are feathered to a zero thickness, these ends being indicated as convexly curved ribs 55. Projecting beyond the ribs is a thin flange 56 that lies flat on the pad 50. The flange 56 has a very shallow (0.020 inch) dam 57 that lies across the three ribs and is the final fluid blocking obstruction of the transverse gasket (FIG. 7).

The three transverse ribs 55 are integral extensions of the ridges 45 on the underside of the gasket. These extensions are adapted to embed themselves into the soft rubber pad 50 to form a seal with it. The dam 57 is perpendicular to the ribs 55 and seals against fluid flow in that direction. The ribs 45 are compressed against the surface of the shoulder 36 and prevent fluid from entering the casket through that joint. Finally, the ribs 41 are compressed against the flange 37 and prevent the flow of fluid into the casket or out of the casket in that direction.

In operation, the head section or head cap is normally opened for viewing. When the burial is to take place, the head section is closed. Across the transverse joint 35, the flange 37 engages the gasket 40 and squeezes it against the shoulder 36 as shown in FIG. 5 and the ribs 55 and dam 57 engage and compress the pad 50 as shown in FIG. 5. The perimeter flanges on the upper sections are compressed against the perimeter or marginal body flange to form a seal with it. In this way all joints are tightly sealed.

From the above disclosure of the general principles of the present invention and the preceding detailed description of a preferred embodiment, those skilled in the art will readily comprehend the various modifications to which the present invention is susceptible. Therefore, I desire to be limited only by the scope of the following claims and equivalents thereof:

I claim:

1. In a casket having a body having a lower marginal flange, a foot top section having an upper marginal flange and a transverse sealing shoulder, a head top section having an upper marginal flange and a transverse sealing flange mating with said shoulder to form a transverse joint, a gasket assembly comprising, a body gasket on said lower marginal flange and engageable by said upper marginal flanges, a transverse gasket on said transverse shoulder, said transverse gasket having an undersurface engaging said shoulder, said surface including three longitudinal ribs and having a feathered end extending beyond said shoulder for contact with said lower marginal flange, said feathered end having on its undersurface three convexly curved longitudinal ribs that embed into said body gasket, said last named longitudinal ribs being continuations of said first named longitudinal ribs, and said ribs tapering to substantially zero thickness at their ends, and a transverse dam across the ends of said longitudinal ribs to block fluid flow past said ribs.

2. In a casket having a body having a lower marginal flange, a foot top section having an upper marginal flange and a transverse sealing shoulder, a head top section having an upper marginal flange and a transverse sealing flange mating with said shoulder to form a transverse joint, a gasket assembly comprising, a body gasket on said lower marginal flange and engageable by said upper marginal flanges, a transverse gasket on said transverse shoulder, two longitudinal parallel ribs on the upper surface of said transverse gasket, two longitudinal parallel grooves on the undersurface of said gasket and aligned with said parallel ribs, said ribs being engageable by said transverse sealing flange to compress said ribs into the space created by said grooves, said two longitudinal grooves being formed by three parallel ridges, said ridges, at the ends of said transverse gasket, being feathered into three parallel ribs, and a transverse flange across the ends of said three parallel ribs to block fluid leakage into or out of said grooves.

* * * * *